United States Patent [19]

Ballu

[11] 4,244,819

[45] Jan. 13, 1981

[54] FLOATING ANTI-POLLUTION BARRIER AND METHOD FOR USING THE SAME

[75] Inventor: Louis Ballu, Epernay, France

[73] Assignee: Pneumatiques Caoutchouc Manufacture et Plastiques Kleber-Colombes, France

[21] Appl. No.: 744,878

[22] Filed: Nov. 24, 1976

Related U.S. Application Data

[63] Continuation-in-part of Ser. No. 586,255, Jun. 12, 1975, abandoned, which is a continuation of Ser. No. 427,531, Dec. 26, 1973, abandoned.

[30] Foreign Application Priority Data

Dec. 26, 1972 [FR] France ..... 72.46285
Mar. 11, 1976 [FR] France ..... 76 06977

[51] Int. Cl.[3] ..... E02B 9/02; C02F 1/24

[52] U.S. Cl. ..... 210/242.3; 210/923; 210/776; 405/68; 405/1

[58] Field of Search ..... 61/1 F, 3–5; 210/65, 83, 242 S, DIG. 25; 405/68

[56] References Cited

U.S. PATENT DOCUMENTS

| | | | |
|---|---|---|---|
| 2,682,151 | 6/1954 | Simpson et al. | 61/1 F |
| 3,577,879 | 5/1971 | Ducrocq | 61/1 F |
| 3,592,008 | 7/1971 | Trindle | 61/1 F |
| 3,613,376 | 10/1971 | Midby | 61/1 F |
| 3,667,235 | 6/1972 | Preus et al. | 210/242 S X |
| 3,710,943 | 1/1973 | Davidson et al. | 210/242 |
| 3,718,001 | 2/1973 | Harper | 61/1 F |
| 3,779,020 | 12/1973 | Muramatsu et al. | 61/1 F |

FOREIGN PATENT DOCUMENTS

| | | | |
|---|---|---|---|
| 2115216 | 10/1971 | Fed. Rep. of Germany | 61/1 F |
| 2226725 | 12/1972 | Fed. Rep. of Germany | 210/242 |
| 1528855 | 6/1968 | France | 61/1 F |
| 1525310 | 10/1968 | France | 210/DIG. 25 |
| 317928 | 11/1969 | Sweden | 61/1 F |
| 843131 | 8/1960 | United Kingdom | 61/1 F |

*Primary Examiner*—Robert H. Spitzer
*Attorney, Agent, or Firm*—Craig & Antonelli

[57] ABSTRACT

A floating anti-pollution barrier for combating water pollution and method of using the same is disclosed. The floating pockets of the barrier, the openings of which are downwardly disposed, are given their shape and kept in shape by masses of a material which is lighter than water. These masses preferably consist of a cellular material which is watertight and minimally compressible, of inflated bladders, or of air blown into the pockets. In a preferred embodiment in which the pockets are given shape by the masses, air enters the shaped pockets and is trapped therein to effect flotation of the barrier, and provisions are made for accommodating retention of the barrier at the surface of the water, even in the event that water fills the pockets, since the masses then act to effect the flotation of the barrier.

3 Claims, 17 Drawing Figures

FLOATING ANTI-POLLUTION BARRIER AND METHOD FOR USING THE SAME

This application is a continuation-in-part of U.S. patent application Ser. No. 586,255, filed June 12, 1975, now abandoned, which is a continuation of U.S. patent application, Ser. No. 427,531, filed Dec. 26, 1973 (now abandoned).

The present invention relates to floating anti-pollution barriers designed to catch bodies or substances floating on the surface of the water. These barriers comprise a weighted skirt which, immersed in the water, constitutes a lower catching screen and a floating element which supports the skirt and which simultaneously constitutes an upper catching screen.

In particular, the invention concerns anti-pollution barriers which are of a flexible material, and (1) of which a flotation element is constructed of a series of pockets, opening downward into which air penetrates before they are placed in the water, for example, at the moment that they are put in the water, and into which the water partially penetrates when they are in the water. These pockets are interconnected together by fabric strips or bands of narrow width relative to that of the pockets (for example, less than a tenth or a twentieth); and the series of pockets is formed by folding a sheet of fabric coated with rubber or plastic along its length and by gluing, sewing, bonding or welding the facing walls to each other along regularly spaced lines which are shorter than the folded sheet (the weld points or stitches or glue points, thus forming the fabric strips or bands interconnecting the pockets, and further, (2) of which the skirt is generally constituted of two parts which are each the extension of the lateral walls of the pockets and which, from place to place, are connected with one another at their bottom edge. The means used for binding these two parts also support a load or weighting chain.

When they are in the water, these anti-pollution barriers function as sort of gutters, of which the open part is turned downward and of which the base includes a series of openings (the pockets) filled partially with air. Anti-pollution barriers thus made of a flexible, watertight material, of which the floating element consists of a series of downwardly opening deformable pockets or cylinders interconnected by fabric strips, have been known for a short time in which, when the barrier is placed in the water, by opening the pockets to permit the introduction of atmospheric air, and then keeping these pockets open until they are blocked by the water, the air contained in each pocket closed in this way on all sides in a sealed manner enables the barrier to float on the surface of the water.

Barriers of this type, especially because of the longitudinal flexibility and the facility of putting them in the water, assure excellent service. But they pose a problem which has not been resolved and which concerns the formation and maintenance of the pocket forms. In fact, the pockets which are of a flexible material must be made and maintained in their form by separation of the opposite walls so as to have and to keep a sufficient space to assure entrance of air and consequent flotation of the barrier, as well as to effectively conform to the surface of the water, and thus form an effective screen under all circumstances.

Up to the present, the only elements disclosed to separate the walls of the pockets have been metallic springs which are compressed when the barrier is in storage and which expand when put in the water, so that when the pockets take their form, putting the barrier into the water is extremely easy and can be accomplished without preparation. In the case of these barriers, as found in applicant's previous U.S. Pat. No. 3,811,285, which was copending with the above-mentioned parent application, Ser. No. 427,531 of which this application is a continuation-in-part the flexible pockets are provided with their shape and kept in this shape by the mechanical means introduced in advance into each pocket and connected to the wall thereof. These are, for example, helicoidal springs with a vertical axis, the coils of which are flattened one against the other when the barrier is in the stored position and are extended when the barrier is placed in the water. As they are extended, the springs open the pockets and keep them open while the barrier is in service.

However, experience has shown that the viability of the barriers provided with springs is not sufficient. For example, when put into polluted water, a part of the barrier can be tilted or even over-turned, such that the pocket openings, instead of being downward, are turned to the side or even upward. Water then fills the pockets and the corresponding part of the barrier is immersed or submerged when the barrier is placed in the water. It also happens that some pockets can be accidentally perforated during service of the barrier, and the resulting deflection of the concerned parts renders the top screen non-existent at these points. It must be noted that these incidents occur neither because of the weight nor because of the operation of the springs.

Furthermore, the mechanical means for providing the pockets with shape and keeping them in this shape, notably when the barriers are intended to remain in place in a permanent manner or when they have to have a large air draw owing to the fact that they are to be located in places where the surface of the water is extremely rough (considerable difference in the level of the crest and the dip in the waves), all have the disadvantage of deteriorating rapidly because, being metal, they are subject to corrosion or because the accumulation of all types of substances in the mechanical device for giving the pockets their shape prevents it from functioning properly.

In addition, the weight of the mechanical means used weights down the floating element of the barrier which prevents the barrier from functioning well. In particular, this affects the excellent longitudinal flexibility which the barriers should possess. Furthermore, the manufacture of barriers where the floating element has a sizeable air draw and the possible winding of these barriers onto a storage wheel is rendered more difficult owing to the bulkiness and rigidity of the means for giving the floating pockets their shape and keeping them in shape.

The object of the present invention is to render the above type anti-pollution barriers entirely viable.

For that, in the barriers according to the invention, the pockets are made and maintained in form by masses of a substantially rigid material of lower density than water. In normal conditions, the flotation of the barrier is essentially assured by the Archimedes thrust which is exerted on the pockets. The masses of material with lower density than water do not particularly take part in the flotation of the barrier, and their role is to keep the opposite sides of the walls of the pockets separated.

But if it happens that water fills one or more pockets, the masses of material with density lower than water do act as floats and thereby prevent immersion of this part of the barrier.

It is important that the masses of material of low density do not entirely fill the pockets. In fact, on the one hand, the floatability of the barrier would be diminished because all of the substantially rigid materials which can be used have a considerably greater density than that of air, and on the other hand, the longitudinal flexibility of the barrier would be effected. These masses thus leave spaces of the pockets free here and there, which communicate with the openings of the pockets. In addition, these masses must have as low as possible density, and in any case lower than that of water, and must be sufficiently rigid to keep the walls of the pockets separated. The materials which can be used, among others, are cork and cellular materials, such as polyurethanes or materials of a thermoplastic base, including polyethylene, polyvinyl chloride, polystyrene, or other analogous materials. These masses can be encapsulated by placing in a tight enclosure or by coating with a material which makes them water impermeable. They can also be formed by pellets or grains or even a gas contained in an enclosure; and they can also be constituted of hollow bodies. The volume of these masses is the volume which, considering the density of the material, assures sufficient floatability when the pockets are filled with water; and their form is such that when the mass of material is placed in a pocket, free spaces filled with air exist at the sides of the masses.

The masses of material with density lower than water have two functions:

(1) to put in form and so maintain the pockets when conditions are normal, and (2) to act as floats and assure flotation of the barrier when the pockets, for one reason or another, have filled with water and can no longer function as floats.

Accordingly, an object of the present invention is to provide a means for giving shape to and keeping in shape the pockets or cylinders constituting the floating element of the above-mentioned type of anti-pollution barriers not having the disadvantages of those known in the prior art, and by implementing this structure, retain all the good operating qualities inherent in these barriers. The present invention also provides a process for giving the floating pockets their shape and keeping them in shape.

A further object according to the present invention, is to provide the pockets of the floating element with floating blocks or masses of a substance which are lighter than water, and which are introduced by way of a lower opening in the pockets. These blocks or masses space apart the walls of the pocket and keep them spaced apart. In this way, the floating properties and the reliability of the operation of the barrier are increased. The manufacture and storage of the barrier are also facilitated. For example, if a pocket is damaged, a minimum air draw is maintained which ensures that an upper screen for catching polluting bodies or substances is provided at this point.

In another object of the present invention, the material which is introduced into the pockets is lighter than water. It may be in the form of a block or a mass or it may be contained in a container having a predetermined shape and predetermined dimensions, such as, for example, deformable bladders filled with air, or blocks of minimally compressible, low density material such as cork, cellular polyurethane, chipped material or straw.

In a further object of the present invention, when the material which is lighter than water is inserted into the pockets where it spaces apart the walls, its volume is less than that of the pockets. Air penetrates and fills the space between the walls and the mass of the material which is lighter than water. As in the case of the barriers already known where the opening in the floating pockets is downwardly directed, when the barriers according to the invention are used, the water seals the opening and rises compressing the air.

According to other embodiments of the present invention, the walls of the pockets are also spaced apart and kept spaced apart by air introduced into the pockets, for example, by directing it beneath the same when the barrier is being placed in position in the water or when it has been placed in the water.

Advantageous embodiments of the present invention also include means for accommodating complete immersion of the antipollution barriers for instances where polluting substances are absent. Such embodiments can then be surfaced by filling the pockets with air. Owing to the opening provided in the lower part of the pockets, part of the air which was blown into the surface of the barrier escapes by itself as the barrier rises so that there is constant equilibrium between the outer pressure and the inner pressure in the pockets. This ensures that the walls of the pockets are not subject to prohibitive stresses.

These and further objects, features and advantages of the present invention will become more apparent from the following description when taken in connection with the accompanying drawings which show, for purposes of illustration only, several embodiments in accordance with the present invention.

Figure 1:
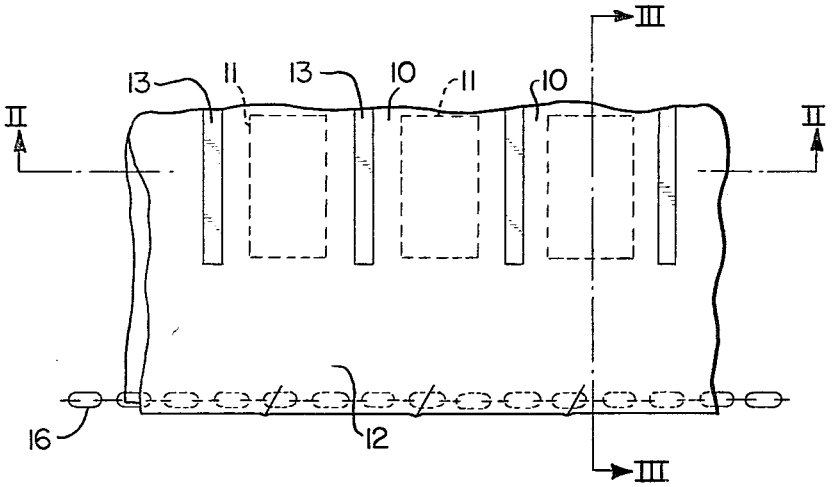
FIG. 1 is an elevational view of a part of a barrier constructed in accordance with the present invention.
Figure 2:
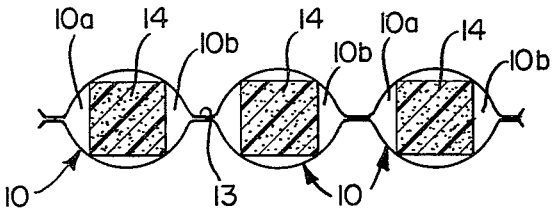
FIG. 2 is a cross-sectional view of one embodiment from above along the line II—II of FIG. 1 with the barrier in water.
Figure 2A:
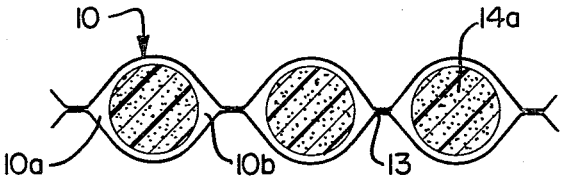
Figure 3:
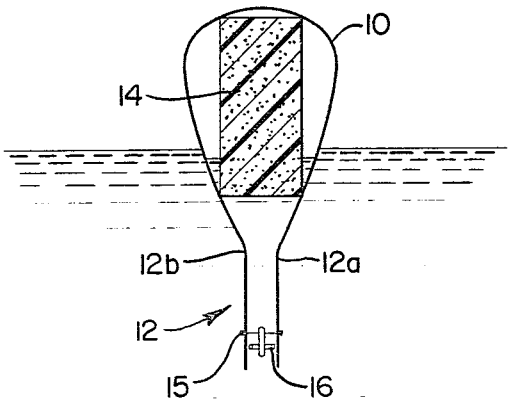
Figure 4:
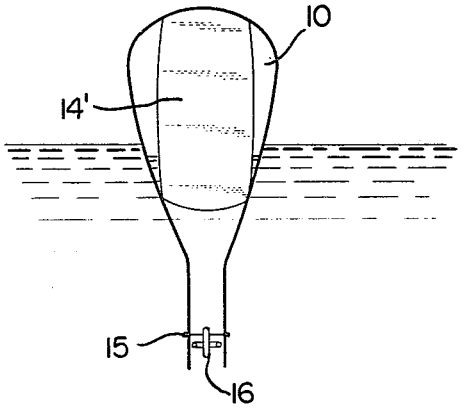
Figure 5:
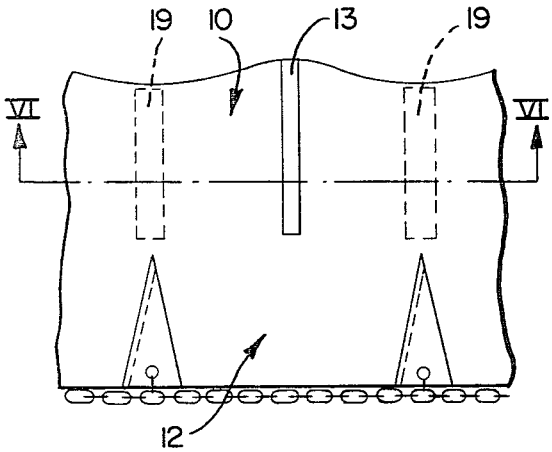
Figure 7:
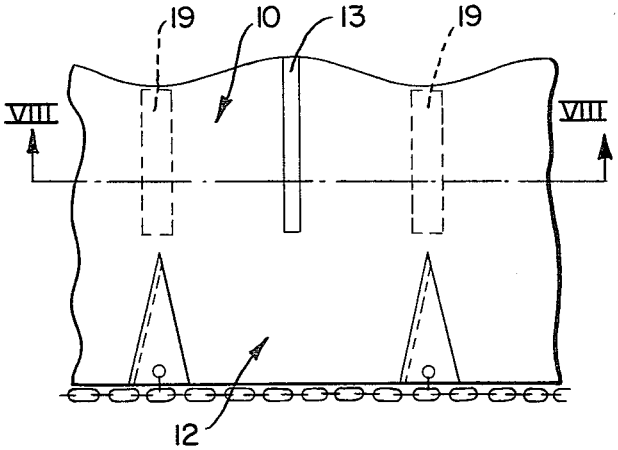
Figure 6:
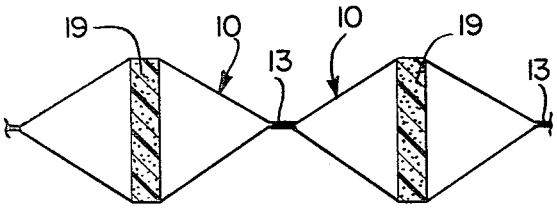
Figure 8:
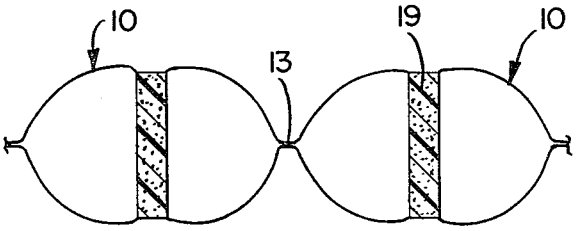
Figure 9:
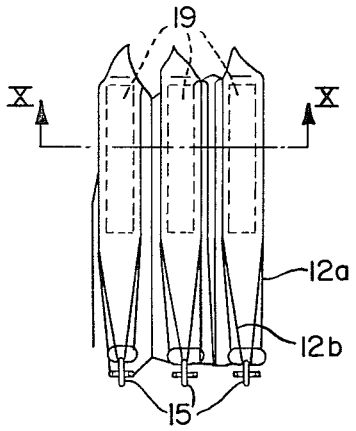
Figure 10:
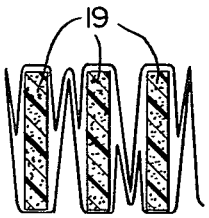
Figure 11:
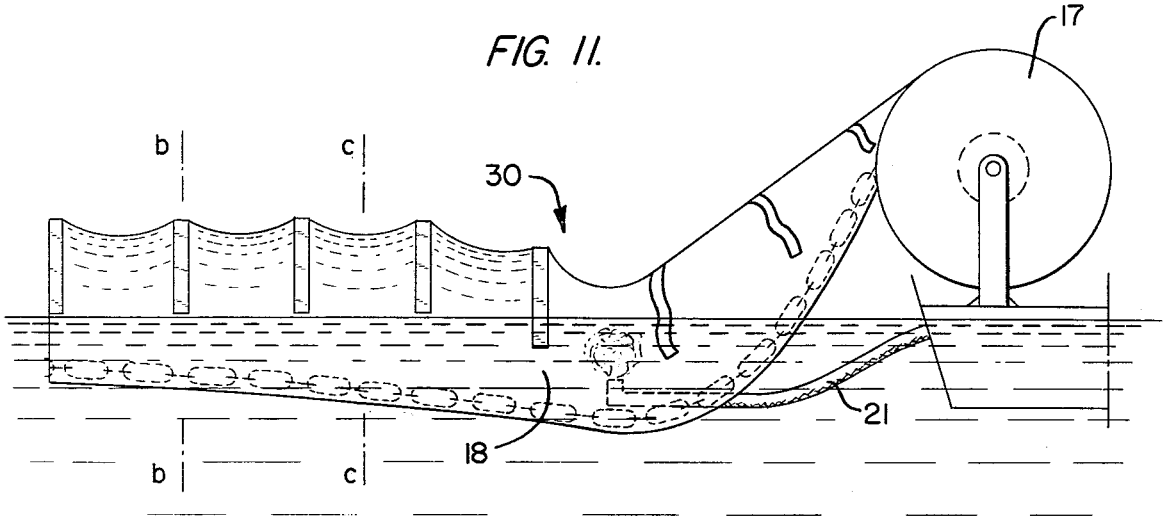
Figure 12:
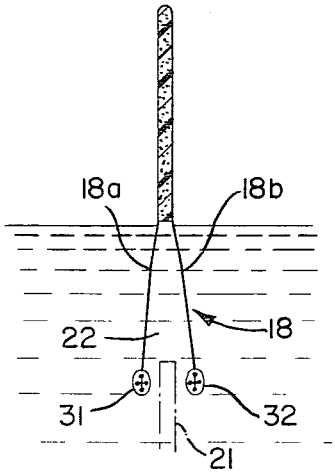
Figure 13:
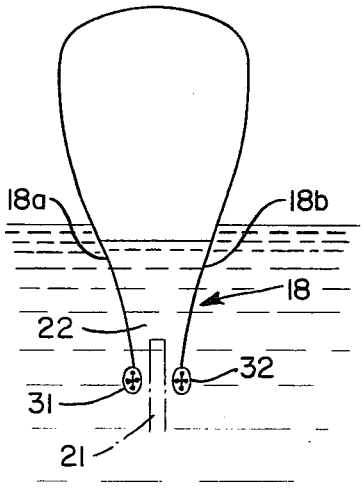
Figure 14:
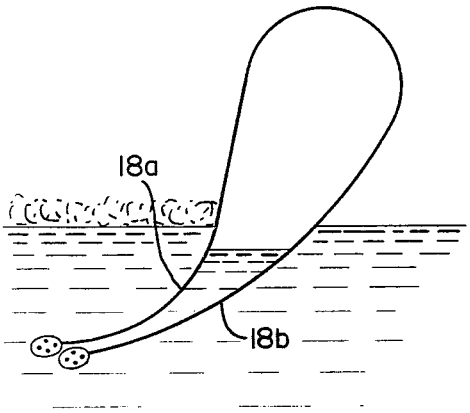
Figure 15:
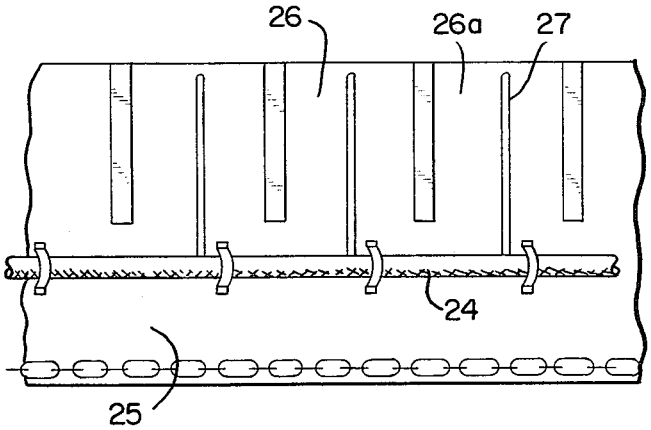
Figure 16:
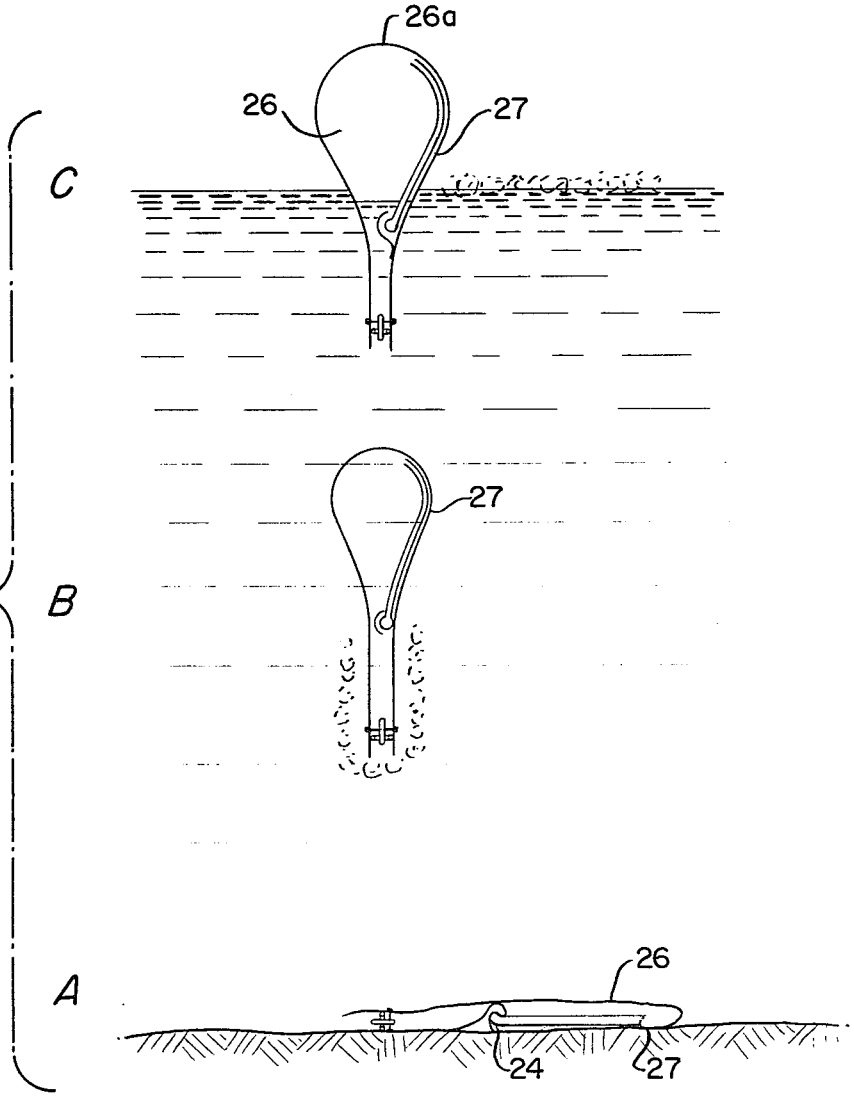

FIG. 2*a* is a cross-sectional view of another embodiment from above along the line II—II of FIG. 1 with the barrier in water;

FIG. 3 is a cross-sectional view of the barrier along the line III—III of FIG. 1 when it is placed in water;

FIG. 4 is a cross-sectional view similar to FIG. 3 which shows another preferred embodiment of a barrier constructed according to the present invention;

FIG. 5 is an elevational view of another embodiment, ready to be put in the water;

FIG. 6 is a cross-sectional view along line VI—VI of FIG. 5;

FIG. 7 is an elevation of the barrier of FIG. 5 when this barrier is in the water;

FIG. 8 is a cross-sectional view along line VIII—VIII of FIG. 7;

FIG. 9 is a cross-sectional view along a vertical plane of the barrier of FIGS. 5 to 8 when it is folded;

FIG. 10 is a cross-sectional view along line X—X of the same folded barrier of FIG. 9;

FIG. 11 is an elevational schematic view illustrating a method of placing a barrier in position in the water according to the invention, the two elements of the skirt of this barrier being weighted individually;

FIG. 12 is a cross-sectional view along the line b—b of the barrier shown in FIG. 11 in position in the water;

FIG. 13 is a cross-sectional view along the line c—c of the barrier shown in FIG. 11 in position in the water;

FIG. 14 is a cross-sectional view of the barrier according to FIG. 11 showing the disposition of the barrier on the water under the action of lateral stresses;

FIG. 15 is a longitudinal sectional view of a part of a barrier constructed according to another embodiment of the invention and which is designed to be immersed; and FIG. 16 is a diagrammatic view showing various positions in the water of the barrier according to FIG. 15.

The floating barrier of the present invention is constructed by taking a sheet of fabric which is sealed and thermocast with a coating of polyvinyl chloride on the two major surfaces, folding the sheet along its length, and placing welds or bonds 13 from place to place, regularly spaced along the bottom length of the folded sheet, as may be seen in FIG. 1. Thus, a series of pockets 10 are realized, which pockets are very widely opened in the downward direction, and interconnected together by the welds 13, constituting bands. The walls of these pockets may extend as the parts 12*a* and 12*b* of the sheet of fabric, situated below weld points 13, as may be seen in FIG. 3, for example. From place to place, the free bottom edges of the folded sheet are bound together by rings 15 which also support a chain 16 serving as a load, and also, for traction of the barrier. The two parts 12*a* and 12*b* form the skirt 12 and the series of pockets 10 form the flotation element when their lateral walls are separated from each other. Before being placed into the water, when the walls of the pockets are separated, air fills these pockets. When the barrier is then put in the water with the walls held apart, the air is imprisoned and very slightly compressed by water which enters between parts 12*a* and 12*b* of the skirt and also into the lower part of each pocket.

The invention discloses means by which the walls of the pockets are separated and maintained apart; and the invention is applicable of course to all anti-pollution barriers in which the flotation element is constituted of a series of downwardly opened pockets, whatever be the means for forming of the pockets or barriers.

FIGS. 1 through 3, for example, show a barrier, the floating pockets 10 of which contain a block or mass 11, such as cellular, watertight material 14 (FIGS. 2 and 3). When stored, the pockets of the barrier do not contain the masses 11, and the barrier represents a flat floating element. It is therefore particularly easy to store this barrier. When the barrier is to be used, the masses 11 are introduced into the pockets by passing them between the two walls 12*a* and 12*b* of the skirt 12 (FIG. 3). The masses 11 may be left free inside each pocket without being fastened to the skirt. They are made of a material which is lighter than water, and they are watertight. The masses preferably consist, for example, of blocks of a cellular material, the majority of the cells of which are closed. Alternatively, the masses preferably consist of blocks of a cellular material coated with a layer which is watertight, or of a plurality of blocks or masses of a material contained in a container. The essential factor is that the masses volume has a well defined shape and they do not soak in water. These blocks or masses 11 which are minimally compressible, space apart the walls of the pockets leaving on either side free spaces 10*a* and 10*b*, into which the air penetrates when the masses 11 are inserted.

In the embodiment, as shown in FIGS. 2 and 3, the walls of pockets 10 are separated and held apart by masses 11 which are expanded polyethylene parallelipipeds 14 introduced into pockets 10 before putting the barrier in the water. As can be noted, especially in FIG. 2, the parallelipiped blocks 14 do not fill the entire pocket, and leave free spaces 10*a* and 10*b* into which air penetrates.

At the time of placing the barrier in the water, the water penetrates between parts 12*a* and 12*b* of the skirt and pushes air under a slight pressure into the pockets. For this reason, the water level within the pockets is lower than the water level outside (see FIG. 3); and when the barrier is in the water, flotation is assured by Archimedes thrust which is exerted both on the immersed part of masses 11 and on the air in pockets 10. Then, because of the existence of free spaces 10*a*, 10*b* filled with air, situated on both sides of masses 11, the pressure is much greater than that exerted on the immersed part of masses 11. The masses 11 then only act to a small degree in the flotation of the barrier.

If it happens that a pocket fills with water, for example, as a result of an accident, then the Archimedes thrust on the masses 11 assures flotation of the barrier. In such an event, the height of the part of the barrier which is out of the water (which is called drawing air) diminshes slightly, but is sufficient to arrest and catch floating materials on the surface of the water. In the embodiment shown, the height of the barrier was 710 mm, the welds or bands 13 has a width of 30 mm, a height of 380 mm, and were spaced 500 mm apart. The parallelipiped blocks 14 were of expanded polyethylene weighing 100 kg per cubic meter and the form of the parallelipiped had a base which was a square of 180 mm for each side and a height of 270 mm.

These parallelipiped blocks 14 need not be affixed to the walls of the pockets. Instead of being parallelipipeds, the masses 11 could be cylindrical, as 14*a* in FIG. 2*a*, elliptical or be constituted of hollow bodies, such as the air filled bladders 14' in FIG. 4. The essential feature being that their density is as low as possible, in other words, lower than that of water, and that their rigidity be sufficient to hold the pocket walls apart.

Thus, as noted above, when the barrier is placed in the water, the air contained in the pockets and between the two walls 12*a* and 12*b* of the skirt 12 is compressed; and the blocks or masses 11 freely disposed in each pocket occupies a central position inside the pocket and are arranged away from the walls of the pocket which they only touch with their tips. Thus, the walls of the pockets which are made of fabric impregnated with rubber or a similar material retain their flexibility entirely.

Further, when the barrier is in service in the water, if one or more pockets are damaged, the masses 11 in the pockets in question remain in place. They fulfill the role of floating elements while keeping the pockets in shape. In this way, the barrier is not immersed and retains its air draw in order to continue to catch polluting materials. If the masses are cylindrical in shape, as in FIG. 2*a*, and are placed vertically on the water as represented in this embodiment, the water draught may be quite high.

In the embodiment shown in FIG. 4, the mass which keeps apart the walls of the pockets 10 is a bladder 14' filled with air at a pressure which is equal to or slightly greater than that of the air contained in the pockets outside the bladder. This pressure is low which means that the presence of the bladders 14' does not affect the flexibility of the barrier.

In the embodiment shown in FIGS. 5 to 10, the barrier is constructed as in the preceding example; welds 13 limit the pockets 10 (and bind them together), and the lateral walls of the pockets 10 are extended downward along the two free parts 12*a* and 12*b*, which together form the skirt 12. The bottom edges of these two parts 12*a* and 12*b* are connected from place to place by rings which support a chain, as above with respect to FIG. 1, for example.

In the embodiment of FIGS. 5 to 10, the height of the barrier is 1,400 mm; and the weld points 13 are 800 mm high, 30 mm wide and 1000 mm apart.

The edges of pockets 10 are separated and held apart by plates 19 which are formed of the same expanded polyethylene as the preceding structure, and which are placed perpendicularly to skirt 12. These plates 19 are 60 mm thick, 600 mm high and 430 mm wide (the width of the plate is the distance which separates the walls of the pockets when they are separated). To avoid displacement and pivoting of the plates, these plates 19 are affixed to the walls of pockets 10 by means of slings (not shown in the drawings) attached to the walls, and by means of laces which pass into these slings and into holes which have been made in plates 19.

To be stored, the barrier with pockets provided with plates is folded by bringing together plates 10; that is shown in FIGS. 9 and 10. Folded, the barrier takes up very little space; and it can easily be placed in containers to be transported.

In use, one end of the barrier is drawn out, and the plates separate from each other such that the pockets 10 take their form (see FIG. 6). It can be done extremely rapidly, for example, with the folded and stored barriers in containers on the deck of a boat, another boat can pull one end of the barrier so that it unfolds and is deposited on the water simultaneously.

The operation is the same as for the barriers of the preceding examples. Water penetrates between the parts 12*a* and 12*b* of the skirt, pushes air into the pockets, which then take the form shown in FIGS. 7 and 8.

If, in the course of putting the barrier in the water as described, or after putting it in the water, one or more pockets are damaged, or the barrier is tilted, so that the water enters into some of the pockets, plates 19 play the role of floats and assure flotation of the affected part of the barrier. Under normal operating conditions, the floats 19 provide practically no flotation of the barrier because the air in the pockets 10, with their walls separated by plates 19, provide flotation of the barrier, the floats having a greater density than air.

In another embodiment (not illustrated), separation of the walls of the pockets of a barrier having the same dimensions as in the preceding example, has been obtained by means of an assembly of several plates of cellular material forming a hollow body.

The arrangement shown in FIG. 11 represents an anti-pollution barrier 30 wound about a wheel or reel 17. This barrier comprises a skirt 18 (FIGS. 12 and 13) consisting of two elements 18*a* and 18*b* which are not interconnected and are spaced from one another at their lower part. In this case, the skirt is weighted by two chains 31 and 32, the one being fastened to the element 18*a* and the other to the element 18*b*. Under these circumstances, the lateral stresses produced, for example, by currents or by the drag of the barrier (sweeping displacement in the water) applies the elements 18*a* and 18*b* one against the other as represented in FIG. 8. This sweeping displacement occurs more or less similarly to an arrangement having a single skirt provided with a chain having twice the weight of the individual chains 31 and 32. In addition, in this way a channel 22 is produced which, when the barrier is put in service in the water, provides a passage for an inflating nozzle or nozzles 21 connected to a compressed air source. This nozzle which is directed upwards blows in air which passes through the channel 22 and fills the floating pockets. In this embodiment, the air fulfills the same role as the masses 11 in the preceding embodiments.

When air alone is used to give shape to the floating pockets and to keep them in shape, it may be blown in by means of a flexible pipe, for example, a pipe made of rubber or similar material placed and held longitudinally in the channel defined by the two parts of the skirt.

This pipe which is fastened to one or to both walls of the skirt comprises opposite each opening in the floating pocket, an orifice or discharge tube directed towards the pocket or possibly even a tube which penetrates the floating pocket. The air feed orifice of each of the pockets is preferably also provided with a pressure limiting means.

The barrier according to FIG. 15 is a barrier of this type having a flexible pipe for inflating air. The device for feeding air into the floating pockets is a flexible pipe 24 longitudinally secured on a wall 25 of the skirt. This pipe 24 supplies each pocket 26 by way of the pipes 27 connected on the main pipe 24 and penetrating the pockets in such a way that the free end of each pipe 27 is disposed in the upper part 26*a* of each pocket (FIG. 16).

This barrier may be totally or partially immersed in such a way as to permit the passage of ships. If the barrier is in place, the air may be discharged from the pockets by means of the pipes 24 and 27 to submerge it, and to put it in position the air may be blown into the pockets by means of these tubes or pipes 24 and 27.

The diagram according to FIG. 16 shows the barrier of FIG. 15 at different levels in the water. In position A, the barrier rests on the bottom. By blowing in air via the pipe 24, each pocket 26 is provided with air which spaces apart its walls and increases its volume. When the hydrostatic thrust is sufficient, the barrier begins to rise and continues until it reaches the surface (position C). The air pressure inside the pockets is constantly substantially equal to the outer pressure which decreases as the barrier rises. The volume of the pockets increases accordingly. When the volume of the air under pressure equal to the hydrostatic pressure becomes greater than the volume of the pockets, the air escapes from the pockets. If, for example, the barrier is immersed under 30 meters of fresh water, the air will have to be blown in at a pressure greater than 3 kg to cause the pockets to begin to take shape. Assuming that the barrier begins to rise when the pockets have reached half their volume and the feeding of air is then stopped, the pockets will have attained their normal shape when the barrier is at less than 15 meters and the air pressure in the pockets will be equilibrated by the outside pressure. As the barrier continues to rise, the outside pressure will continue to decrease and the air will escape from the pockets in such quantity that the inside pressure is constantly in equilibrium with the outside pressure. Accordingly, the pressure of the air inside the pockets is never maintained greater than the outside pressure. As a result, the walls of the pockets are never subjected to considerable stresses which would make it necessary for these walls to be made of a material having a very high mechanical resistance.

In the case of the barriers according to the invention, the presence of a means enabling a fluid to be injected into the floating pockets of the barrier at any particular time also makes it possible to inject a product for combating fire whenever this might be necessary. It also provides the barrier with protection against fires. This advantage is especially important when the polluting bodies or substances present a danger of inflammation or when these are actually on fire. This may be the case, for example, with a petroleum slick. By injecting carbonic gas foam into the floating pockets of the barrier, the foam, after filling the pockets, leaves the barrier at its lower part and rises to the surface of the water, mixing with the polluting substances.

While I have shown and described herein several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are encompassed by the scope of the appended claims.

What I claim:

1. In a floating anti-pollution barrier of the type including a submerged skirt-like structure, float means for supporting said skirt-like structure, said float means comprising a plurality of pocket-like means, each being air-tight and having an opening facing in the downward direction, said plurality of pocket-like means being connected with one another by a plurality of pliable bands separating each of said pocket-like means, and means for shaping said pocket-like means such that air filling said pocket-like means is imprisoned in said pocket-like means by water when the barrier is placed in water, the improvement comprising said means for shaping being spacing members which extend transversely to said pocket-like means and space apart opposite walls of said pocket-like means, said spacing members having a density of lower than water, and each of said spacing members having a volume less than the volume of each of said pocket-like means such that free air spaces which communicate with said opening of said pocket-like means are provided in each of said pocket-like means to effect primary floating support of said skirt-like structure by compressed air in said pocket-like means, wherein said spacing members are in the form of flat plates of air-tight cellular material having a major dimension disposed perpendicularly to said skirt-like structure, said flat plates being secured to opposing walls of said pocket-like means, and wherein said spacing members have a volume sufficiently large to provide secondary floating support of said skirt-like structure by said pocket-like means in the event that water fills said pocket-like means.

2. A floating anti-pollution barrier according to claim 1, wherein said spacing members extending transversely to said pocket-like means form said free air spaces on either side of the flat plate surfaces of said spacing member in each of said plurality of pocket-like means.

3. A method of establishing a floating anti-pollution barrier according to claim 1 in water comprising the steps of inserting said spacing members into said pocket-like means, thereby separating opposing walls of said pocket-like means to create said free air spaces in said pocket-like means, and placing said barrier into a body of water with air in said free air spaces being compressed by water entering into said pocket-like means, thereby creating Archimedes thrust on the compressed air to establish floating support of said submerged skirt-like structure.

* * * * *